US006457823B1

(12) United States Patent
Cleary et al.

(10) Patent No.: US 6,457,823 B1
(45) Date of Patent: Oct. 1, 2002

(54) APPARATUS AND METHOD FOR SETTING RADIATION-CURABLE INK

(75) Inventors: Arthur L. Cleary; Joseph A. Lahut, both of Center Harbor, NH (US)

(73) Assignee: VUTEk Inc., Meredith, NH (US)

( * ) Notice: Subject to any disclaimer, the term of this patent is extended or adjusted under 35 U.S.C. 154(b) by 0 days.

(21) Appl. No.: 09/834,999

(22) Filed: Apr. 13, 2001

(51) Int. Cl.[7] ..... B41J 2/01
(52) U.S. Cl. ..... 347/102
(58) Field of Search ..... 347/1.2, 43, 44, 347/40, 37, 102, 216, 103; 219/216

(56) References Cited

U.S. PATENT DOCUMENTS

| | | | | |
|---|---|---|---|---|
| 4,340,893 A | | 7/1982 | Ort | 346/1.1 |
| 4,970,528 A | | 11/1990 | Beaufort et al. | 346/25 |
| 4,978,969 A | * | 12/1990 | Chieng | 346/1.1 |
| 5,041,846 A | | 8/1991 | Vincent et al. | 346/25 |
| 5,130,726 A | | 7/1992 | Fukushima et al. | 346/140 |
| 5,220,346 A | | 6/1993 | Carreira et al. | 346/1.1 |
| 5,294,946 A | | 3/1994 | Gandy et al. | 346/140 |
| 5,376,957 A | | 12/1994 | Gandy et al. | 347/3 |
| 5,526,190 A | * | 6/1996 | Hubble, III et al. | 359/719 |
| 5,638,098 A | | 6/1997 | Iwata et al. | 347/9 |
| 5,732,633 A | * | 3/1998 | Herskowits | 101/487 |
| 6,145,979 A | | 11/2000 | Caiger et al. | 347/102 |
| 6,312,123 B1 | * | 11/2001 | Codos et al. | 347/102 |

FOREIGN PATENT DOCUMENTS

| | | | | |
|---|---|---|---|---|
| EP | 0 284 215 B1 | | 1/1992 | B41J/2/005 |
| EP | 0 622 194 B1 | | 9/1997 | B41J/2/01 |
| GB | 2142579 B | | 1/1985 | B41M/7/00 |
| JP | 60-132767 | * | 7/1985 | |
| JP | 61-209163 | | 9/1986 | B41J/3/04 |
| JP | 63-62738 | | 3/1988 | B41J/3/04 |
| WO | WO 97/04964 | | 2/1997 | B41J/2/17 |

* cited by examiner

*Primary Examiner*—Anh T. N. Vo
*Assistant Examiner*—Ly T Tran
(74) *Attorney, Agent, or Firm*—Hamilton, Brook, Smith & Reynolds, P.C.

(57) ABSTRACT

An apparatus for setting radiation curable ink deposited onto a substrate. The apparatus includes a series of ink jet print heads which deposit ink onto the substrate, and a radiation source mounted laterally adjacent to the series of ink jet print heads. The amount of energy provided by the radiation source is sufficient to cause the radiation curable ink to set.

15 Claims, 9 Drawing Sheets

APPARATUS AND METHOD FOR SETTING RADIATION-CURABLE INK

BACKGROUND

Certain types of printing systems are adapted for printing images on large-scale substrates, such as for museum displays, billboards, sails, bus boards, and banners. Some of these systems use so-called drop on demand ink jet printing. In these systems, a carriage which holds a set of print heads scans across the width of the substrate while the print heads deposit ink as the substrate moves.

Solvent based inks are sometimes used in these systems in which an infrared dryer is used dry off the solvent after the ink is deposited onto the substrate. Systems using solvent based inks are able to print on flexible substrates such as PVC materials and reinforced vinyl. However, solvent based inks are typically considered to be unusable for printing on rigid substrates such as metals, glass, and plastics. Therefore, to print on rigid, as well as flexible substrates, radiation-curable inks such as UV-curable inks are often preferred. For these systems, the ink is deposited onto the substrate and then cured in a post-printing stage. For instance, after the deposition of the ink, the substrate moves to a curing station. The ink is then cured, for example, by exposing it to UV radiation. In other systems, the UV radiation source for curing is mounted directly on the same carriage that carries the set of print heads.

SUMMARY

During the printing process, UV curable ink must be cured within a short time period after it has been deposited on the substrate, otherwise ink with positive dot gain may spread out and flow away, or ink with negative dot gain may ball up and roll away. UV radiation sources mounted on the carriage are capable of emitting radiation at high enough energies to cure the ink within such time frames. However, a significant amount of power must be supplied to the UV radiation source to enable it to emit these high energies. Typical UV radiation sources are quite inefficient since most of the emitted radiation is unusable. In fact, upwards of 95% of the emitted radiation is not used because the source emits radiation with wavelengths over a spectrum which is much wider than the usable spectrum. In addition, to ensure that the required amount of radiation is transmitted to the ink, the carriage must scan across the substrate at moderate speeds, even though the print heads are capable of depositing ink onto the substrate at much higher carriage speeds.

It is desirable, therefore, to set (i.e. pre-cure) the ink rather than fully cure it as the ink is deposited on the substrate so that the ink does not spread or ball up, even though it is still in a quasi-fluid state (i.e. the ink is not completely hardened). The energy required to set the ink is typically about 5% of the energy necessary to cure the ink. Such an arrangement requires less power, and, therefore, facilitates using smaller UV radiation sources. In addition, a lower energy output requirement would allow the carriage to operate at a higher speed. Hence, images can be printed at a higher rate, resulting in a higher throughput.

The present invention implements an apparatus for setting radiation curable ink deposited on a substrate. Specifically, in one aspect of the invention, the apparatus includes a series of ink jet print heads which deposit ink onto the substrate, and a radiation source mounted laterally adjacent to the series of ink jet print heads. The amount of energy provided by the radiation source is sufficient to cause the radiation curable ink to set. The set energy is typically about 5% of the energy required to cure the ink.

In certain embodiments of this aspect, the radiation source is a UV source and the ink is UV-curable. The radiation source can be a multiplicity of light emitting diodes (LED). The LEDs are lighter and smaller and require less power to operate. Because LEDs are capable of emitting radiation within a very narrow wavelength band, for example, 365 nm, they are very efficient. The LEDs can be pulse-width modulated such that the LEDs are capable of operating over a wider power range than traditional glow bulbs, such as mercury vapor lamps.

Embodiments of this aspect of the invention can also include one or more of the following features. The series of ink jet print heads traverses across the substrate from about 10 inch/sec to about 60 inch/sec, and the power emitted by the radiation source is about 50 W/inch. The system can include a radiation curing station which cures the ink after it has been set. The radiation curing station can be mounted on a carriage which carries the series of ink jet print head, or the UV curing station can be a stand alone unit which may or may not be attached to the printing system.

The series of print heads can include a first set of print heads for depositing black ink, a second set of print heads for depositing magenta colored ink, a third set of print heads for depositing yellow colored ink, and a fourth set of print heads for depositing cyan colored ink.

In some arrangements, the first, second, third, and fourth set of print heads are aligned linearly along either side of an axis that is substantially orthogonal to an axis of travel of the series of ink jet print heads. In other arrangements, the first, second, third, and fourth set of print heads are aligned linearly along an axis that is substantially parallel to an axis of travel of the series of ink jet print heads.

There can be a second radiation source, in which case the series of print heads are located between the two radiation sources.

Related aspects of the invention include a method to set radiation curable ink during a printing process. The method includes depositing the ink onto the substrate with a series of ink jet print heads. As a carriage holding the print heads traverses across the substrate, the method includes setting the ink with radiation emitted from a radiation source that is positioned laterally adjacent to the series of ink jet print heads.

Embodiments of this aspect may include setting the ink with UV radiation, for example, radiation with a wavelength of about 365 nm. The radiation source can emit with a power of about 50 W/inch. The method may also include curing the ink after the ink has been set. The depositing step may include depositing black ink from a first set of print heads, depositing magenta colored ink from a second set of print heads, depositing yellow colored ink from a third set of print heads, and depositing cyan colored ink from a fourth set of print heads. Still other aspects, features, and advantages follow.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
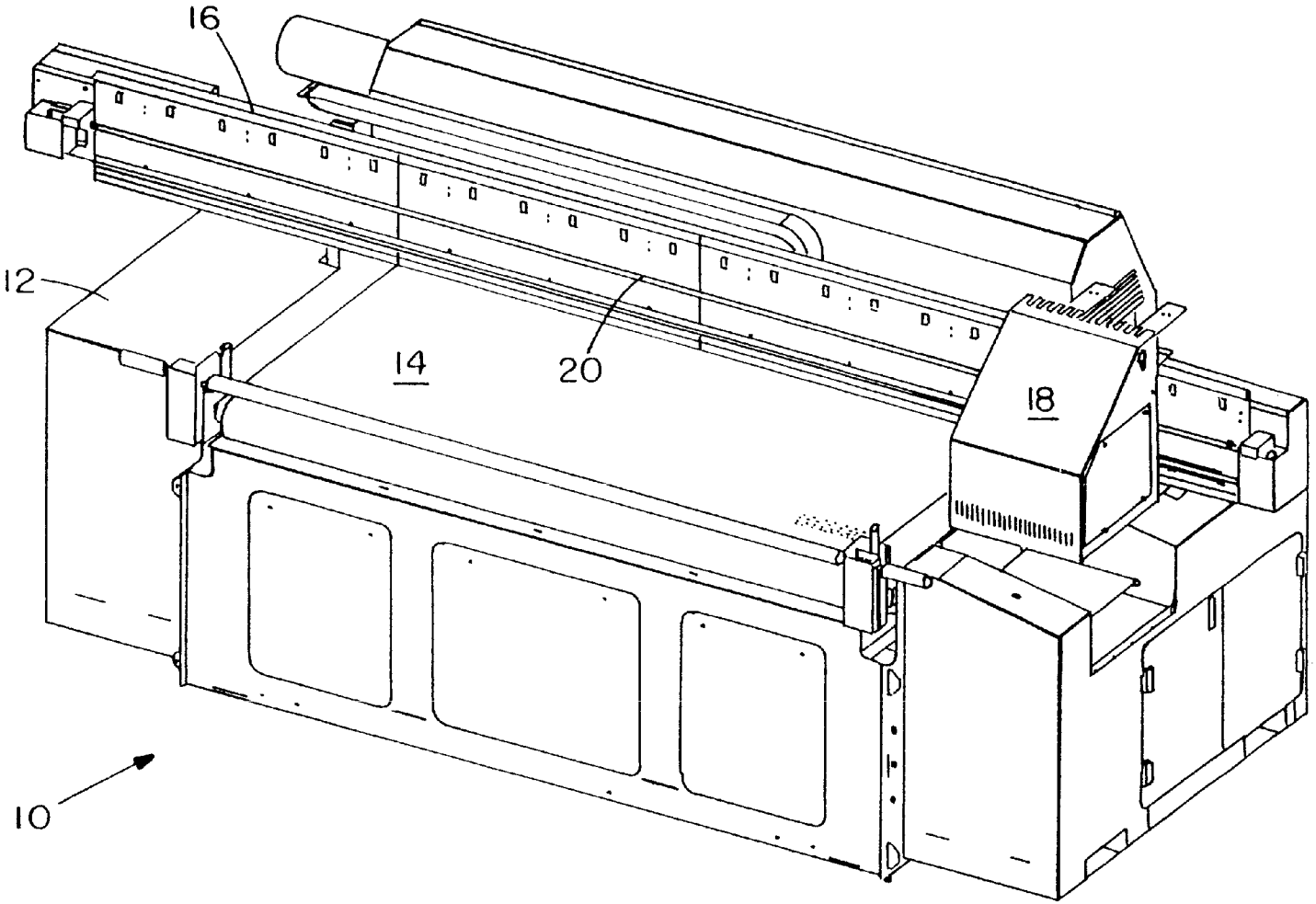
FIG. 1 is an perspective view of a printing system in accordance with the invention.

A description of preferred embodiments of the invention follows. Turning now to the drawings, there is shown in FIG. 1 a printing system 10 adapted for printing images on a variety of substrates. Typical substrates are polyvinyl chloride (PVC) and reinforced vinyl which can be provided with peal-off backings to expose pressure sensitive adhesive. The printing system 10 is able to print on flexible as well as on non-flexible substrates, for example, metals, glass, and plastics.

The printing system 10 includes a base 12, a transport belt 14 which moves the substrate through the printing system, a rail system 16 attached to the base 12, and a carriage 18 coupled to the rail system 16. The carriage 18 holds a series of inkjet print heads and one or more radiation sources, such as UV radiation sources, and is attached to a belt 20 which wraps around a pair of pulleys (not shown) positioned on either end of the rail system 16. A carriage motor is coupled to one of the pulleys and rotates the pulley during the printing process. As such, when the carriage motor causes the pulley to rotate, the carriage moves linearly back and forth along the rail system 16.

Figure 2A:
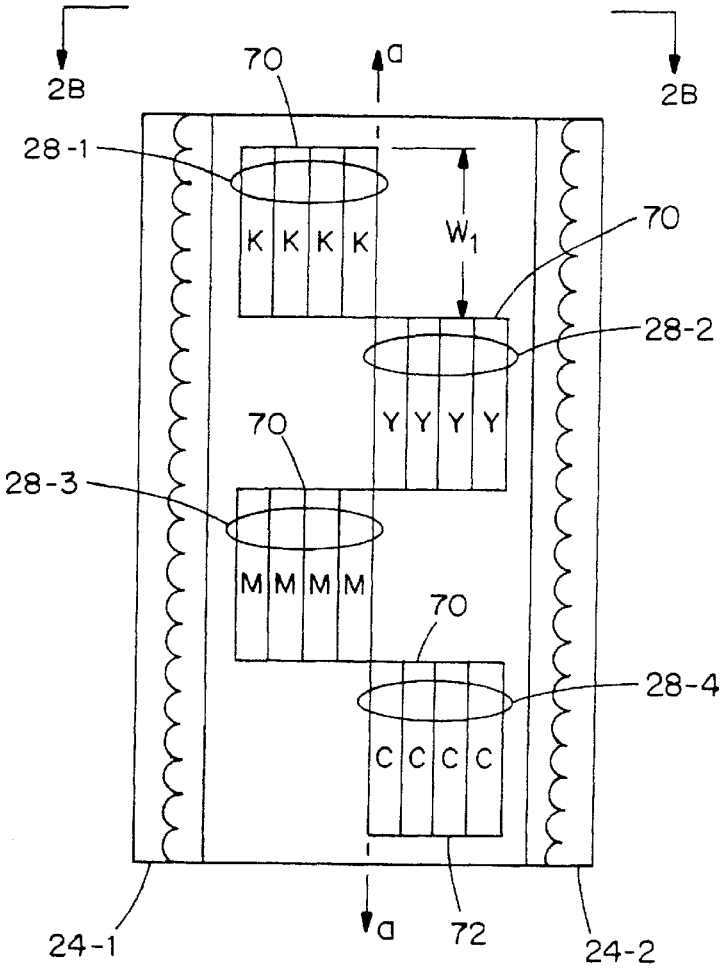
FIG. 2A is a bottom view of a carriage of the printing system of FIG. 1 holding a series of inkjet print heads and a pair of UV radiation sources.
Figure 2B:
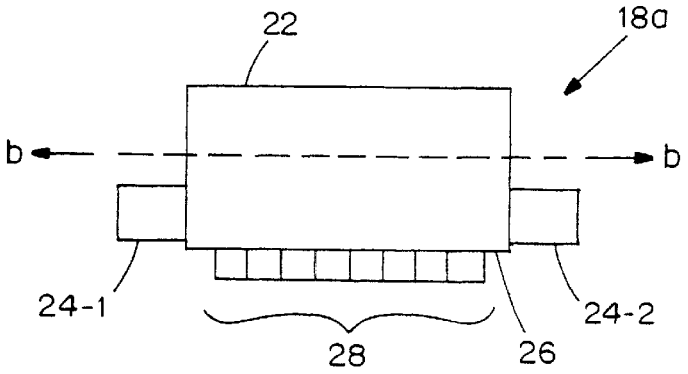
FIG. 2B is a view along line 2B—2B of the carriage of FIG. 2A.
Figure 3:
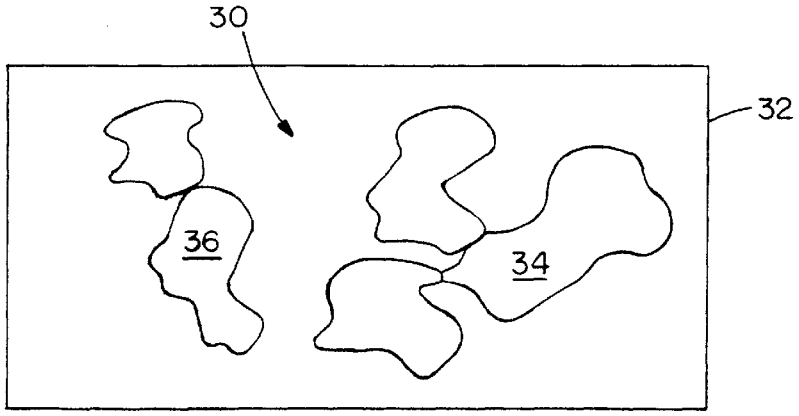
FIG. 3 is a schematic of an image printed by the printing system of FIG. 1.

The print heads and the UV radiation sources mounted to the carriage are illustrated in more detail in FIGS. 2A and 2B. As shown, a carriage (referred to as carriage 18*a* for this embodiment) includes a housing 22 encasing a pair of UV radiation sources 24-1 and 24-2 attached to and positioned on either side of a carriage frame 26. A series of "drop on demand" inkjet print heads 28 is also mounted on the carriage frame 26 and positioned between and laterally adjacent to the UV radiation sources 24. The series of inkjet print heads 28 includes a set of black (K) print heads 28-1, a set of yellow (Y) print heads 28-2, a set of magenta (M) print heads 28-3, and a set of cyan (C) print heads 28-4. Each set of print heads 28 is positioned on either side of an axis, a—a, that is substantially orthogonal to an axis, b—b, along which the carriage 18*a* traverses. The print heads 28 are arranged so that during the printing process the black print heads 28-1 first deposit black ink, then the yellow print heads 28-2 deposit yellow colored ink, followed by the deposition of magenta ink from the magenta print heads 28-2, and finally the cyan print heads 28-1 deposit cyan colored ink. These colors alone and in combination are used to create a desired image 30 on a substrate 32 (FIG. 3). Thus, the image 30 is made of regions having no ink or one to four layers of ink. For example, a green region 34 of the image 30 is produced by depositing two layers of ink, namely, yellow and cyan. And an intense black region 36 of the image 30 results from dispensing all four colors, cyan, magenta, yellow, and black. As such, this intense black region 36 is made of four layers of ink.

Although certain regions of the image 30 are made with multiple layers of ink, and all four sets of the print heads 28 may simultaneously deposit ink onto the substrate 32, only one layer of ink is deposited at a given time on the portion of the substrate that is positioned beneath a respective set of print heads as the carriage scans across the substrate.

Figure 4A:
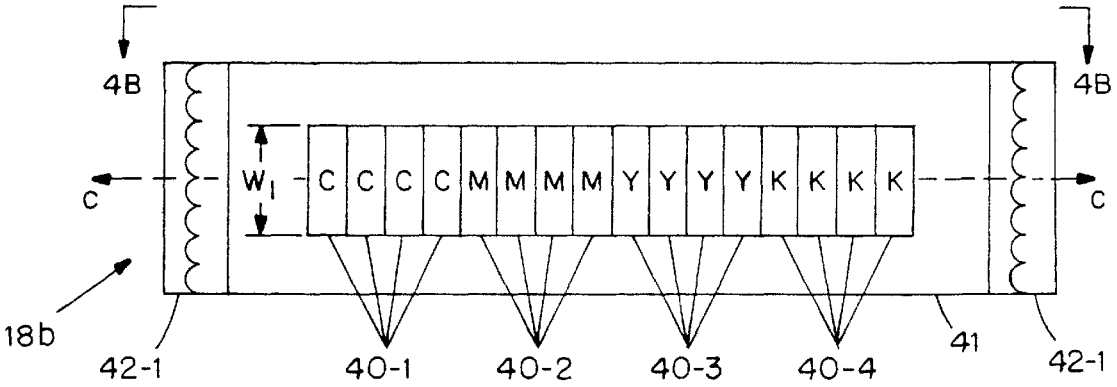
FIG. 4A is a bottom view of an alternative embodiment of the carriage of the printing system of FIG. 1.
Figure 4B:
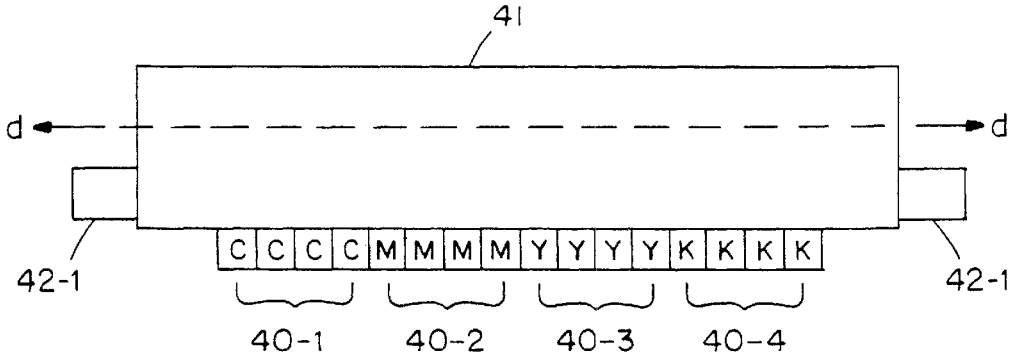
FIG. 4B is a view along line 4B—4B of the carriage of FIG. 4A.

In an alternative embodiment of the invention is illustrated in FIGS. 4A and 4B where a carriage 18*b* holds a series of ink jet print heads 40 which may deposit four layers of ink simultaneously on the region of substrate located beneath the four sets of print heads 40-1, 40-2, 40-3, 40-4. In this embodiment, the set of cyan (C) print heads 40-1, the set of magenta (M) print heads 40-2, the set of yellow (Y) print heads 40-3, and the set of black (K) print heads 40-4 are positioned on a carriage frame 41 and aligned along an axis, c—c, that is substantially parallel to an axis, d—d, of travel of the carriage 18*b*. The print heads 40 are positioned between a pair of UV radiation sources 42-1 and 42-2 attached on either side of the carriage frame 41.

Figure 5A:
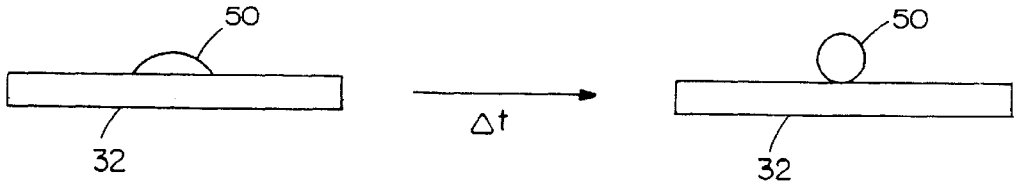
FIG. 5A is an illustrated time sequence of ink deposited on a substrate by the printing system of FIG. 1 for droplets having negative dot gain.
Figure 5B:
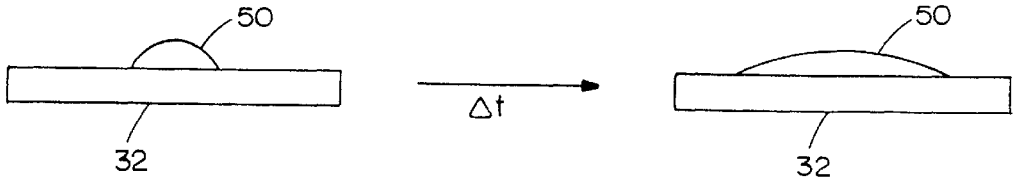
FIG. 5B is an illustrated time sequence of ink deposited on a substrate by the printing system of FIG. 1 for droplets having positive dot gain.

A typical ink jet printing ink has a viscosity of about 10 centipoise. Thus, as shown in FIG. 5A, ink 50 deposited on the substrate 32, over time some time period $\Delta t$, will contract and ball up and most likely roll away because of the low liquid viscosity and surface tension effects, exhibiting what is known as negative dot gain. In some instances the ink exhibits positive dot gain behavior as shown in FIG. 5B, where after the ink 50 is deposited on the substrate 32, the ink expands and spreads out. To prevent either of these behaviors, the UV radiation sources 24-1 and 24-2 of the carriage 18*a* (FIG. 2), or the UV radiation sources 42-1 and 42-2 of the carriage 18*b* (FIG. 4) expose the ink with UV radiation after the deposition of the ink onto the substrate. The amount of energy, referred to as the "set energy," is sufficient to cause the ink to set. In prior art printing systems which cure the deposited ink, the UV radiation sources emit with a power output of about 300 W/inch for a linear carriage speed of about 20 in/sec to provide 800 mj/cm$^2$ which is the energy required to cure the ink. The set energy, however, is typically about 5% of the cure energy, that is, about 40 mj/cm$^2$. Thus, for a carriage speed of 20 in/sec, approximately 15 W/inch is required to set the ink. In the present printing system 10, the carriage speed ranges from about 10 inch/sec to about 60 inch/sec. The UV radiation sources 24-1 and 24-2 of the carriage 18*a* (or 42-1 and 42-2 of the carriage 18*b*), therefore, must emit at about 50 W/inch to set the ink at the higher carriage speed to provide the necessary 40 mj/cm$^2$. Of course, 50 W/inch will be more than adequate to set the ink at the lower carriage speed but below that for curing the ink, since the 50 W/inch at a carriage speed of 10 inch/sec would correspond to about 240 mj/cm$^2$.

Figure 6:
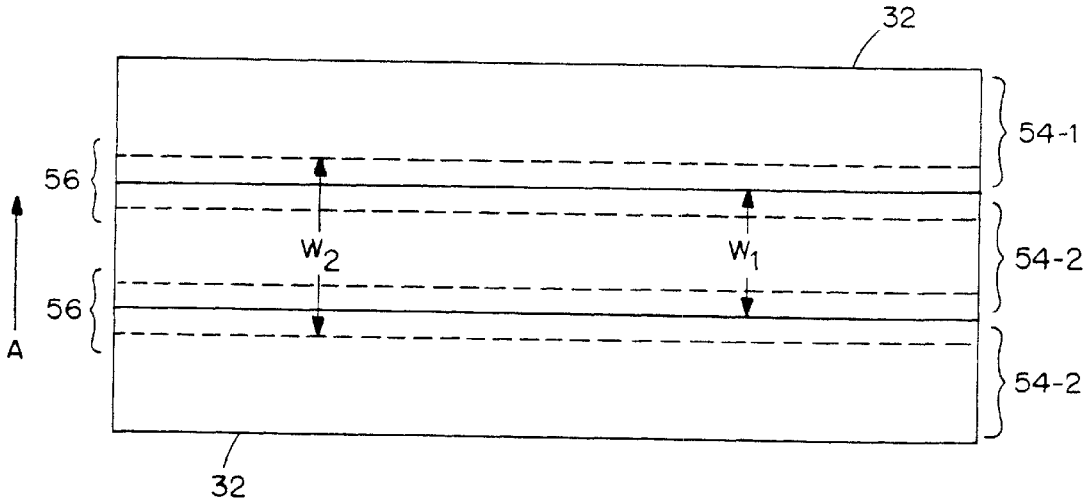
FIG. 6 is an illustration of a sequence of paths of the print heads of the printing system of FIG. 1.

Referring to FIG. 6, as the carriage 18*b* (FIGS. 4A and 4B) traverses across the substrate 32, the print heads 40 mounted on the carriage create a sequence of paths 54 of deposited ink on the substrate 32. The print heads 40 deposit ink along a first path 54-1, then a second path 54-2, followed by a third path 54-3 and so on as the carriage 18*b* goes back and forth across the substrate 32 while the substrate moves through the printing system in the direction of arrow A. These paths 54 have a width, "$w_1$," of about two inches which correspond to the length of the print heads 40 (as well as that of the print heads 28 mounted on the carriage 18*b*). During the deposition of ink along each path, however, the width, "$w_2$," of the region exposed to UV radiation from the UV radiation sources 42-1 and 42-2 is about three inches. This region is wider than $w_1$ to ensure that the ink deposited onto the substrate is not under exposed. There is, therefore, a sequence of regions 56 exposed to UV radiation twice as the carriage 18*b* scans back and forth across the substrate 32.

Note that the print heads 28 of the carriage 18*a* (FIGS. 2A and 2B) also generate a similar sequence of print paths with overlap regions which are exposed multiple times to radiation emitted by the radiations sources 24-1 and 24-2. But rather than being exposed to the UV radiation twice as with the arrangement of carriage 18*b,* these overlap regions are exposed to the radiation five times because of the arrangement of the print heads 28. That is, the overlap region 56 is exposed for each pass of a respective print head 28 corresponding to a top edge 70 of each set of the print heads 28. This region is then exposed a fifth time which corresponds to a bottom edge 72 of the cyan print heads 28-4.

Recall that about 800 mj/cm$^2$ is required to cure the ink and about 40 mj/cm$^2$ is necessary to set the ink. Therefore, at first blush, for the printing system 10 using the carriage 18*a,* it would appear that the overlap regions 56 are exposed to about 200 mj/cm$^2$ (5× of 40 mj/cm$^2$) for carriage speeds of 60 inch/sec and 1200 mj/cm$^2$ for carriage speeds of 10 inch/sec. Although 200 mj/cm$^2$ is well below the amount of energy required to the cure the ink, 1200 mj/cm$^2$ is well above the required cure energy. However, a 30× exposure of 40 mj/cm$^2$ is not equivalent to a single exposure of 1200 mj/cm$^2$.

Figure 7A:
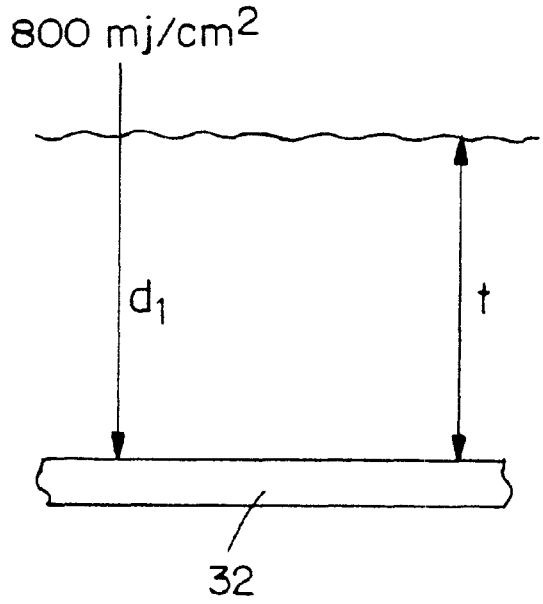
FIG. 7A is a schematic illustration of a penetration depth through ink deposited on a substrate for a UV radiation source having an intensity of about 800 mj/cm$^2$.
Figure 7B:
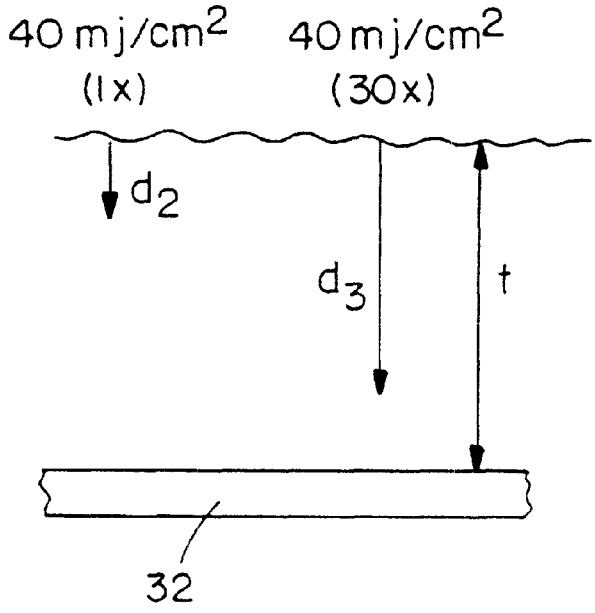
FIG. 7B is a schematic illustration of the penetration depth through ink deposited on a substrate for a UV radiation source having an intensity of about 40 mj/cm$^2$ for a single exposure and for multiple exposures.
Figure 8A:
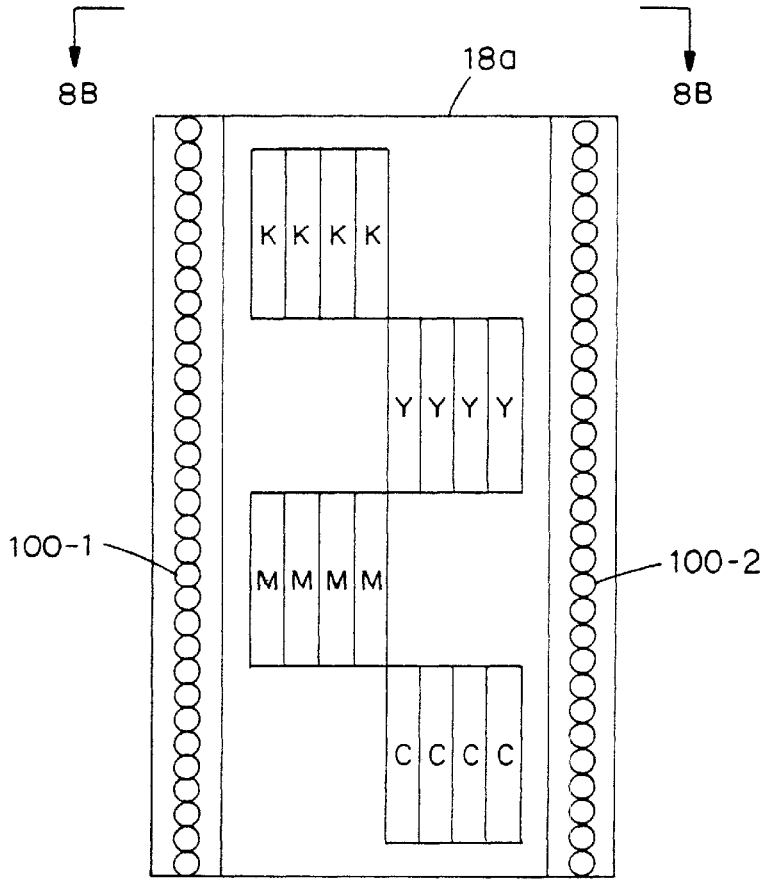
FIG. 8A is a bottom view of the carriage of FIG. 2A with a set of LED UV radiation sources.
Figure 8B:
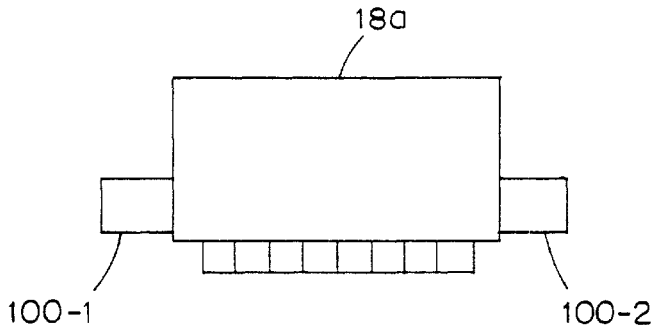
FIG. 8B is a view along line 8B—8B of FIG. 8A.
Figure 9A:
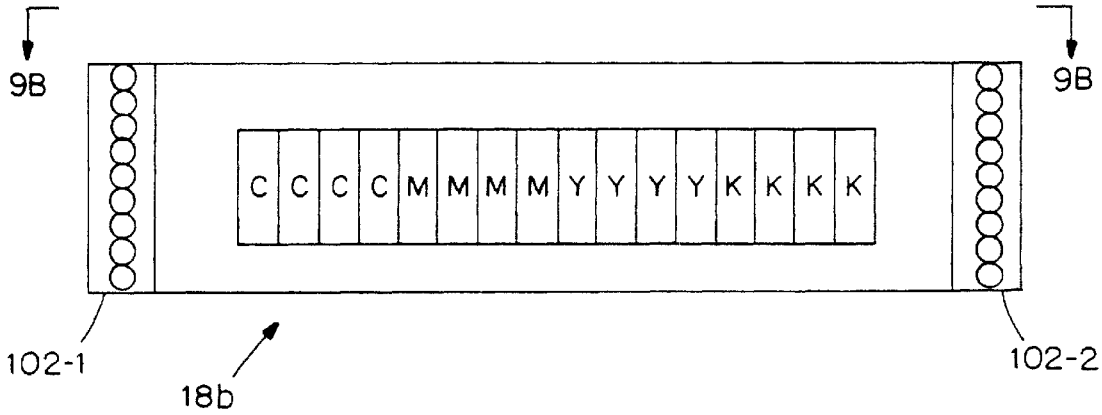
FIG. 9A is a bottom view of the carriage of FIG. 3A with a set of LED UV radiation sources.
Figure 9B:
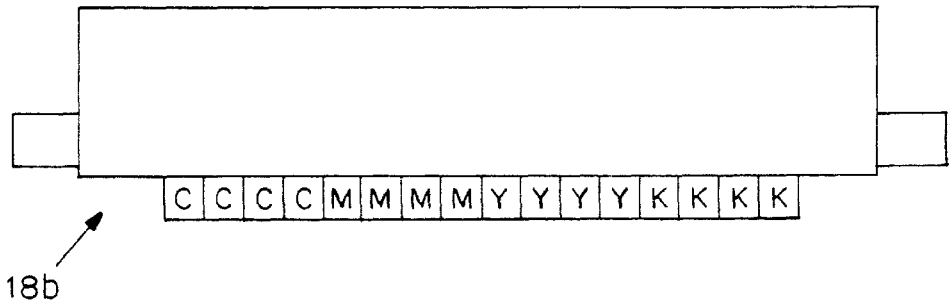
FIG. 9B is a view along line 9B—9B of FIG. 9A.

This is best illustrated with reference to FIG. 7. As illustrated in FIG. 7, for a single exposure of radiant energy of 800 mj/cm$^2$, the radiant energy penetrates to a depth, "$d_1$," which is equivalent to the thickness, "t," of the deposited ink. That is, the ink is fully cured because the radiant energy is able to penetrate through the entire thickness of the ink. And for a single exposure of 40 mj/cm$^2$, the radiation penetrates to a depth of $d_2$. But for a 30× exposure of 40 mj/cm$^2$, the total accumulated penetration depth is $d_3$ which is significantly less than $30 \times d_2$, and in fact is less than $d_1$. Thus, with the carriage 18*a* operating at a scan speed of 10 inch/sec, the energy the ink receives is sufficient to set the ink but not to cure it.

Figure 10:
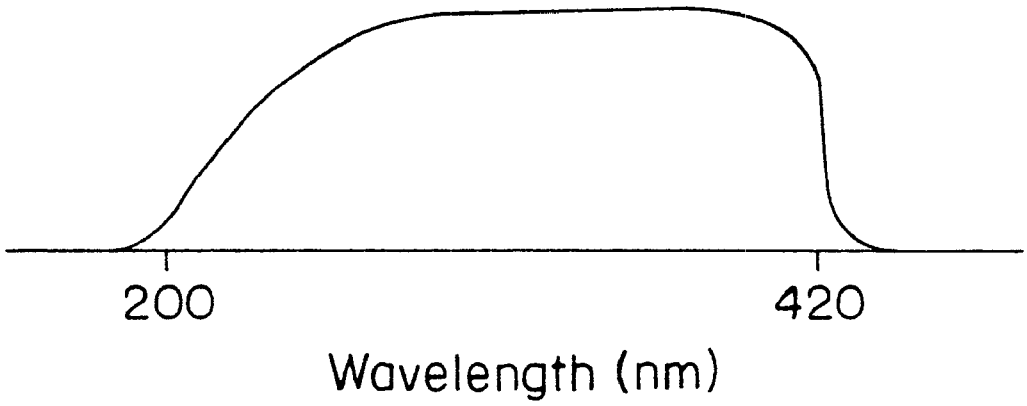
FIG. 10 is an illustrative comparison between the spectrum of a standard UV radiation source and the spectrum of a LED UV radiation source.
Figure 10:
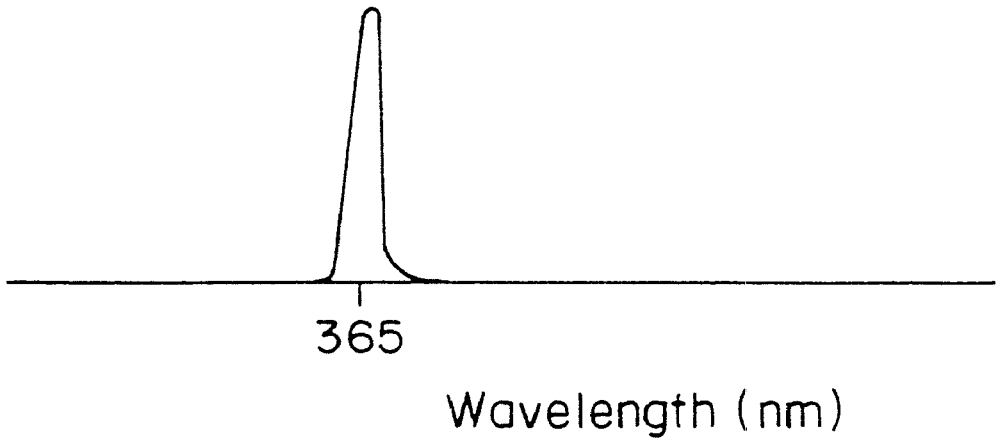

With most UV radiation sources, much of the radiation transmitted by the source is unusable. For example, traditional glow bulbs emit energy from a wavelength of about 200 nm to about 420 nm (FIG. 10A). However, typical UV-curable ink requires UV radiation with a wavelength of about 365 nm to photoinitiate the setting and subsequent curing of the ink. Thus, up to 95% of the emitted radiation is wasted. Thus in alternative embodiments, as illustrated in FIGS. 8A and 8B and FIGS. 9A and 9B, the carriage 18*a* and the carriage 18*b* are provided with light emitting diodes (LEDs) 100 which emit the UV radiation. These LEDs are tuned to emit at the wavelength of 365 nm over a very narrow bandwidth (FIG. 10B).

Further, traditional glow bulbs, for example, mercury vapor lamps) require about 3000 volts to provide the required energy to cure the ink. But when the voltage supplied to traditional glow bulbs is reduced to provide the set energy (5% of the cure energy), the ends of the lamp cool initially and the plasma extinguishes at these ends. As such, the traditional glow bulb is unable to provide a uniform radiation source along its length for both curing and setting applications. LEDs, however, can be pulse-width modulated so that the ends of the radiation source do not extinguish which ensures that the radiation emitted by the LED radiation sources is uniform along the length of the radiation source regardless whether the radiation source is used to cure and/or to set the ink.

Other features of LEDs make them highly desirable for use as UV radiation sources. For instance, LEDs weigh less, require less energy to operate, do not emit wasteful energy, and are physically smaller.

Figure 11:
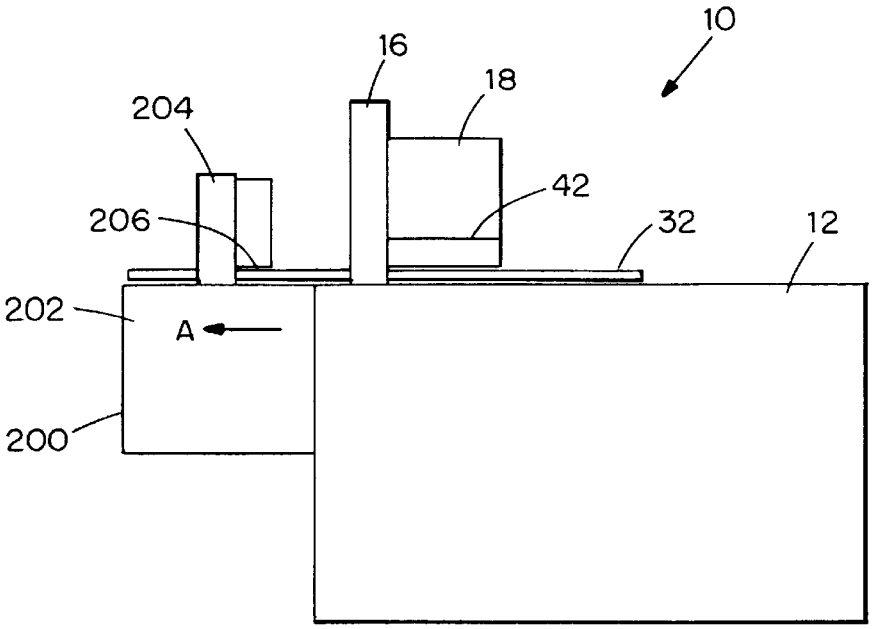
FIG. 11 is an illustration of the printing system with an attached curing station.

The above discussion has been directed to printing systems with a UV setting capability. However, as illustrated in FIG. 11, the system can be combined with a curing station. As shown there, the printing system 10 is provided with the carriage 18 which holds the ink jet print heads and the UV radiation sources for setting the UV curable ink, as discussed previously. In addition, the printing system 10 includes a curing station 200 attached to the base of the printing system 10. The curing station 200 has a station base 202 upon which is mounted a stand 204. A UV-curing source 206 is supported by the stand 204. Thus, as the substrate 32 progresses through the printing system 10 in the direction of arrow A, the print heads of the carriage 18 deposit ink onto the substrate while the radiation sources 42 (or alternatively sources 28 of carriage 18*a*) transmit energy to the ink deposited onto the substrate to set and fix the ink in place. Subsequently, that portion of the substrate moves to the curing station 200. The UV-curing source 206 then emits a sufficient amount of to fully cure the ink.

Figure 12:
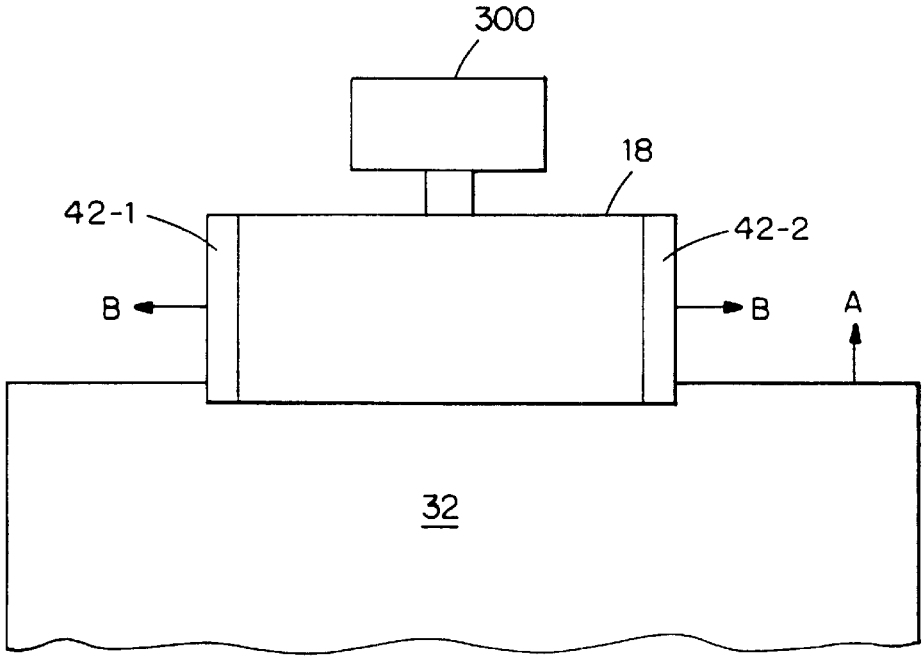
FIG. 12 is depicts an alternative embodiment of the printing system with a curing station attached to the movable carriage.

In another embodiment shown in FIG. 12, a curing station 300 is attached directly to the carriage 18. Thus, as the substrate 32 moves intermittently in the direction of arrow A through the printing system, ink which had been set by the radiation sources 42-1, 42-2 as the carriage 18 traverses back and forth across the substrate 32, as indicated by the double arrow B—B, is subsequently cured with the curing station 300 which emits radiation with an intensity higher than that of the radiation sources 42-1, 42-2 used to set the ink.

While this invention has been particularly shown and described with references to preferred embodiments thereof, it will be understood by those skilled in the art that various changes in form and details may be made therein without departing from the scope of the invention encompassed by the appended claims. For example, the carriage 18 can be provided with a Xenon flash tube as the UV radiation source rather than the radiation sources discussed above. Further, the curing station can be separate stand alone unit unattached to the base 12 or the carriage 18 of the printing system 10.

What is claimed is:

1. An apparatus, comprising:

a series of ink jet print heads which deposit radiation curable ink onto a substrate; and at least one radiation source mounted laterally adjacent to the series of ink jet print heads which deliver a set energy to cause the ink to set to a non-hardened quasi-fluid state, the set energy being about 5% of a cure energy required to frilly cure and harden the ink.

2. The apparatus of claim 1, wherein the radiation source is a UV radiation source and the ink is UV-curable.

3. The apparatus of claim 1, wherein the radiation source is a multiplicity of light emitting diodes (LED).

4. The apparatus of claim 3, wherein the radiation emitted by the LEDs has a wavelength of about 365 nm.

5. The apparatus of claim 1, further comprising a rail system and a carriage which holds the series of ink jet printheads and is coupled to the rail system, the carriage adapted for moving along the rail system such that the series of ink jet print heads traverses across the substrate from about 10 inch/sec to about 60 inch/sec.

6. The apparatus of claim 1, wherein the radiation source has a power output of about 50 W/inch.

7. The apparatus of claim 1, wherein the series of print heads include a first set of print heads for depositing black ink, a second set of print heads for depositing magenta colored ink, a third set of print heads for depositing yellow colored ink, and a fourth set of print heads for depositing cyan colored ink.

8. The apparatus of claim 7, wherein the first, second, third, and fourth set of print heads are aligned linearly along either side of an axis that is substantially orthogonal to an axis of travel of the series of print heads.

9. The apparatus of claim 7, wherein the first, second, third, and fourth set of print heads are aligned linearly along an axis that is substantially parallel to an axis of travel of the series of print heads.

10. The apparatus of claim 1, further comprising a second radiation source, the set of print heads being positioned between the two radiation sources, the print heads and the two radiation sources being mounted to a carriage coupled to a rail system, the first radiation source delivering the set energy when the carriage traverses along the rail system in a first direction, and the second radiation source delivering the set energy when the carriage traverses along the rail system in an opposite direction.

11. A method for setting ink, comprising:

depositing the ink onto the substrate with a series of ink jet print heads; and emitting a set energy from a radiation source that is positioned laterally adjacent to the series of ink jet print heads to cause the ink to set to a non-hardened quasi-fluid state, the set energy being about 5% of a cure energy required to fully cure and harden the ink.

12. The method of claim 11, wherein setting includes setting with UV radiation, and the ink is UV curable.

13. The method of claim 12, wherein the UV radiation has a wavelength of about 365 nm.

14. The method of claim 11, wherein the radiation source has a power output of about 50 W/inch.

15. The method of claim 11, wherein the depositing includes depositing black ink from a first set of print heads, depositing magenta colored ink from a second set of print heads, depositing yellow colored ink from a third set of print heads, and depositing cyan colored ink from a fourth set of print heads.

* * * * *

UNITED STATES PATENT AND TRADEMARK OFFICE

CERTIFICATE OF CORRECTION

PATENT NO. : 6,457,823 B1 
DATED : October 1, 2002
INVENTOR(S) : Arthur L. Cleary and Joseph A. Lahut It is certified that error appears in the above-identified patent and that said Letters Patent is hereby corrected as shown below:

Column 7,
Line 15, delete “frilly” and insert -- fully --.

Signed and Sealed this

Eleventh Day of February, 2003

JAMES E. ROGAN
*Director of the United States Patent and Trademark Office*